US005894099A

United States Patent [19]

Niitsuma

[11] Patent Number: 5,894,099

[45] Date of Patent: Apr. 13, 1999

[54] KEYBOARD APPARATUS FOR ACOUSTIC PIANOS

[75] Inventor: Shinji Niitsuma, Shizuoka-ken, Japan

[73] Assignee: Kabushiki Kaisha Kawai Gakki, Shizuoaki-ken, Japan

[21] Appl. No.: 08/939,438

[22] Filed: Sep. 29, 1997

Related U.S. Application Data

[63] Continuation of application No. 08/507,210, Jul. 26, 1995, abandoned.

[30] Foreign Application Priority Data

Jul. 27, 1994 [JP] Japan ..... 6-194927
Jul. 27, 1994 [JP] Japan ..... 6-194928
Jul. 27, 1994 [JP] Japan ..... 6-194929

[51] Int. Cl.[6] ..... G10C 3/12

[52] U.S. Cl. ..... 84/433; 84/430

[58] Field of Search ..... 84/433, 462, 432, 84/430, 170, 171, DIG. 7

[56] References Cited

U.S. PATENT DOCUMENTS 4,272,657 6/1981 Iijima ..... 200/5 A
5,386,083 1/1995 Kawamura ..... 84/719

*Primary Examiner*—Brian Sircus
*Assistant Examiner*—Shih-yung Hsieh
*Attorney, Agent, or Firm*—Evenson, McKeown, Edwards & Lenahan, P.L.L.C.

[57] ABSTRACT

A keyboard apparatus for an acoustic piano having strings includes keys, a key bed supporting the keys such that they are turnable thereon, an action mechanism arranged at a rear end portion of each of the keys which operates in a manner interlocked with key depression to strike the associated string to generate a musical tone, and a key sensor switch mounted on the key bed for generating key depression information of the keys. The key sensor switch is formed by a rubber switch, and removably mounted on the key bed. Alternatively, the key sensor switch is movably mounted on the key bed such that the key sensor switch can be moved between a detecting position in which the key sensor switch can be depressed by any key depressed, and a non-detecting position in which the key sensor switch cannot be depressed by any key depressed.

17 Claims, 11 Drawing Sheets

KEYBOARD APPARATUS FOR ACOUSTIC PIANOS

This application is a continuation of application Ser. No. 08/507,210, filed on Jul. 26, 1995, now abandoned.

BACKGROUND OF THE INVENTION

1. Field of the Invention

This invention relates to a keyboard apparatus for an acoustic piano having key sensor switches incorporated therein for generating key depression information, such as a muting piano and an autoplay piano.

2. Prior Art

The muting piano is a piano which is capable of giving not only a normal acoustic performance by causing hammers to strike strings e.g. when the performance is given during daytime, but also a muting performance by causing a built-in tone generator to generate electronic musical tones based on key depression information for a player to listen to the electronic musical tones through headphones, while preventing hammers from striking the strings, thereby preventing the musical tones from bothering neighbors. In this case, the key sensor switches are used for generating key depression information during the muting performance for generating the electronic musical tones.

The autoplay piano is a piano adapted to give an automatic performance by driving under control of a control unit an actuator, such as a solenoid, which is provided under each key at a rear end portion thereof, at predetermined timings, to cause the actuator to thrust the rear end portion of the key upward. In this case, the key sensor switches are used for generating key depression information during the acoustic performance by the autoplay piano to store the key depression information into a memory. The control unit directs the automatic performance by reading out the key depression information stored in the memory.

A key sensor switch employed in these kinds of acoustic piano has been conventionally proposed e.g. by Japanese Provisional Patent Publication (Kokai) No. 3-161795, which includes a shutter plate fixed to the bottom surface of the associated key, and two photoswitches arranged below the shutter plate at respective upper and lower levels. Each photoswitch is formed by a photocoupler comprised of a light-emitting element, such as a light-emitting diode, and a light-receiving element, such as a photodiode. When a key is depressed, the shutter plate associated therewith passes between the light-emitting element and the light-receiving element of each photoswitch to block of light transmitted from the light-emitting element toward the light-receiving element. The light-blocked state is detected by the light-receiving element to generate key depression information, i.e. occurrence of a key depression and the speed of the key depression (velocity). Thus, the key depression information is generated in the non-contacting state of keys in which the keys are not brought into mechanical contact with the key sensor switches, thereby preventing the key touch from being adversely affected during the acoustic performance.

However, in the case of the proposed key sensor switch, two photoswitches formed of expensive photocouplers are necessitated for each key, and hence the component cost of the key sensor switches becomes very high. Further, the key sensor switch is constructed such that it generates key depression information when the shutter plate blocks off light transmitted from ore element to the other of each of the photoswitches arranged at different levels. Therefore, it is necessary to mount each shutter plate with a very high accuracy. Therefore, the position adjustment of a shutter plate becomes a very delicate and troublesome matter, which, if carried out on all of the eight-eight keys of the keyboard, necessitates an immense tine period, resulting in a large increase in the manufacturing cost.

SUMMARY OF THE INVENTION

It is an object of the invention to provide a keyboard apparatus for an acoustic piano which is capable of reducing the cost of key sensor switches while preserving an excellent key touch of the keyboard apparatus.

To attain the above object, according to a first aspect of the invention, there is provided a keyboard apparatus for an acoustic piano having strings, including:

keys;

a key bed supporting the keys such that the keys are turnable thereon;

an action mechanism arranged at a rear end portion of each of the keys for striking an associated one of the strings to generate a musical tone in a manner interlocked with depression of the each of the keys; and a key sensor switch arranged on the key bed for generating key depression information for the each of the keys.

The key sensor switch according to the first aspect of the invention is characterized in that the key sensor switch is formed of a rubber switch and removably mounted on the key bed.

According to the keyboard apparatus of the first aspect of the invention, when a key is depressed, the associated action mechanism operates in a manner interlocked with the key depression to strike the string to generate a musical tone, whereby the acoustic performance is given. On the other hand, the key sensor switch generates the key depression information and transmits a signal indicative thereof to a predetermined control unit and a memory.

In the keyboard apparatus of the present invention, the key sensor switch is formed of a rubber switch, which, compared with a photoswitch, considerably reduces the material cost for the switch, and can be mounted on the key bed with ease in a short time period after it is assembled from its component parts into one piece. As a result, the cost of the key sensor switch can be minimized.

Further, since the key sensor switch is removably mounted on the key bed, the key sensor switch can be removed when no key depression information is required but a player desires to give only the acoustic performance. Therefore, the key touch is not adversely affected at all during the acoustic performance.

Preferably, tie keyboard apparatus includes a base having a plurality of key sensor switches mounted thereon in parallel with each other in a manner corresponding to respective ones of the keys, the base being removably mounted on the key bed.

According to this preferred embodiment, the plurality of key sensor switches can be simultaneously mounted on the key bed and removed therefrom only by mounting the base on the key bed and removing the same therefrom, which facilitates the mounting and removing of the key sensor switches.

Further preferably, the key bed has an opening vertically extending therethrough, and the base is removably arranged in the opening of the key bed.

For example, the base is fixed to the key bed with screws.

The keyboard apparatus for an acoustic piano according to a second embodiment of the invention is characterized in that the key sensor switch is formed of a rubber switch, and movably arranged in the key bed such that the key sensor switch can be moved from a detecting position in which the key sensor switch can be depressed by any of the keys, and a non-detecting position in which the key sensor switch cannot be depressed by any of the keys.

According to the keyboard apparatus of the second embodiment, when a key is depressed, the action mechanism operates in a manner interlocked with the key depression to strike the string to generate a musical tone, whereby the acoustic performance is given. On the other hand, when the key sensor switch is in the detecting position, it is depressed by the key depressed to generate key depression information and transmits a signal indicative thereof to a predetermined control unit and a memory. Further, when it is not necessary to generate any key depression information but the player desires to give only the acoustic performance, the key sensor switch is moved to the non-detecting position to prevent the key from depressing the key sensor switch. As a result, the key sensor switch does not affect the key touch at all during the acoustic performance.

Further, the key sensor switch is formed of a rubber switch, which, compared with the photoswitch, considerably reduces the material cost for the switch, and can be mounted on the key bed with ease in a short time period after it is assembled into one piece. As a result, the cost of the key sensor switch can be minimized.

Preferably, the keyboard apparatus includes a base having a plurality of key sensor switches mounted thereon in parallel with each other in a manner corresponding to respective ones of the keys, the base being movably mounted on the key bed.

According to this preferred embodiment, the plurality of key sensor switches can be simultaneously moved only by moving the base relative to the key bed, which, facilitates the shifting of the key sensor switch between the detecting position and the non-detecting position.

Further preferably, the key sensor switch is slidably arranged in the key bed such that the key sensor switch can be slid between the detecting position and the non-detecting position.

According to this preferred embodiment, the key sensor switch is slid between the detecting position and the non-detecting position, and hence the shifting or movement of the key sensor switch can be realized by a simple and convenient construction.

Further preferably, the keyboard apparatus includes a base having a plurality of key sensor switches mounted thereon in parallel with each other in a manner corresponding to respective ones of the keys, the base being slidably mounted on the key bed.

According to this preferred embodiment, the plurality of key sensor switches can be simultaneously slid only by sliding the base relative to the key bed, which even more facilitates the shifting of the key sensor switch between the detecting position and the non-detecting position.

Further preferably, the key bed has an opening vertically extending therethrough, and a casing fit in the opening, the base being slidably arranged in the casing.

Further preferably, the keyboard apparatus includes at least one solenoid interposed between the base and a bottom of the casing, and the at least one solenoid causes the base to slide such that the key sensor switches are moved between the detecting position and the non-detecting position.

Alternatively, the keyboard apparatus includes at least one eccentric cam interposed between the base and a bottom of the casing, and the at least one eccentric cam causes the base to slide such that the key sensor switches are moved between the detecting position and the non-detecting position.

According to this preferred embodiment, the shifting of the key sensor switches between the detecting position and the non-detecting position is further facilitated.

In another preferred embodiment, the key sensor switch is pivotally mounted on the key bed such that the key sensor switch can be pivotally moved between the detecting position and the non-detecting position.

According to this preferred embodiment, when the player desires to give only the acoustic performance, the key sensor switch can be pivotally moved to the non-detecting position to prevent the keys from depressing the key sensor switch. Therefore, the key torch is not adversely affected by the key sensor switches at all during the acoustic performance.

Preferably, the keyboard apparatus a base having a plurality of key sensor switches mounted thereon in parallel with each other in a manner corresponding to respective ones of the keys, the base being pivotally mounted on the key bed.

According to this preferred embodiment, the plurality of key sensor switches can be simultaneously pivotally moved only by pivotally moving the base relative to the key bed, which even more facilitates the shifting of the key sensor switches between the detecting position and the non-detecting position.

Further preferably, the key bed has an opening vertically extending therethrough, and a casing fit in the opening, the base being pivotally arranged in the casing.

Further preferably, the keyboard apparatus includes at least one solenoid Interposed between the base and a bottom of the casing, and the at least one solenoid causes the base to pivotally move such that the key sensor switches are moved between the detecting position and the non-detecting position.

Alternatively, the keyboard apparatus includes at least one eccentric cam interposed between the base and a bottom of the casing, and the at least one eccentric cam causes the base to pivotally move such that the key sensor switch are moved between the detecting position and the non-detecting position.

According to these preferred embodiments, it is still more easy to move or shift the key sensor switches between the detecting position and the non-detecting position.

The above and other objects, features and advantages of the present invention will become more apparent from the following detailed description taken in conjunction with the accompanying drawings.

DETAILED DESCRIPTION

Figure 1:
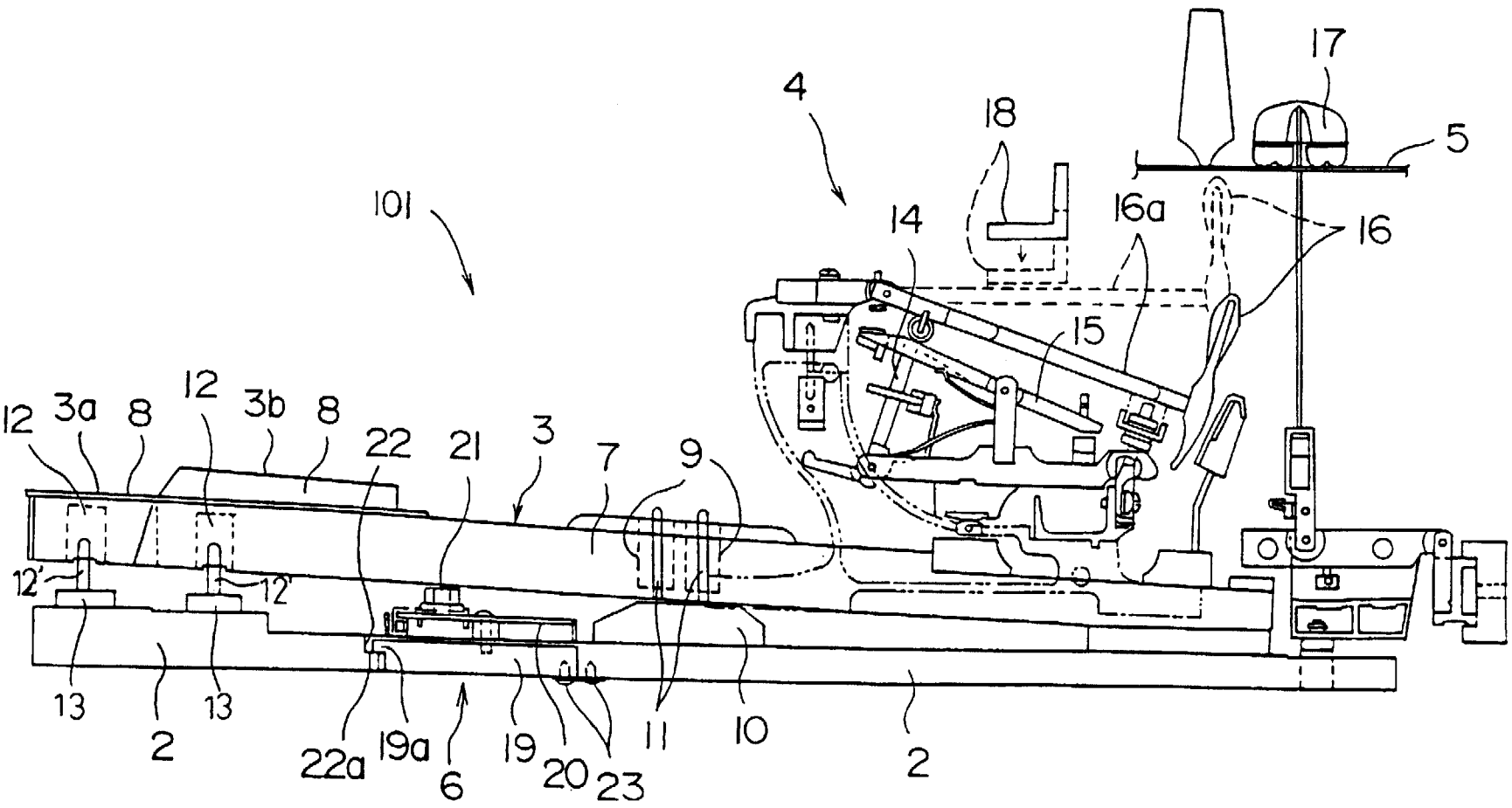
FIG. 1 is a side elevation showing a keyboard apparatus according to a first embodiment of the invention.

Now, the invention will now be described with reference to the drawings showing preferred embodiments thereof.

In the following description, component parts and elements which correspond to each other and are similar in construction and function are designated by identical reference numerals, and repetition of detailed description thereof is omitted.

Referring first to FIG. 1, there is shown a keyboard apparatus 101 for a grand piano equipped with a muting function, which is comprised of a key bed 2 extending longitudinally (in a side-to-side direction as viewed from the figure), eighty-eight keys 3 (only one of them is shown) mounted on the key bed 2 such that they are turnable thereon, an action mechanism 4 provided at a rear end portion of each key 3, strings 5 extending horizontally, a key sensor switch device 6 for generating key depression information of each key 3, and a control unit and a tone generator, neither of which is shown, for generating electronic musical tones based on the key depression information generated by the key sensor switch device 6.

The keys 3 are constituted by white keys **3*a* and black keys 3*b*. Each key 3 is comprised of a key body 7 made of wood and extending longitudinally, and a key skin 8 made of resin and bonded to a front end of the key body 7. The key 3 is formed with a balance pin hole 9 which vertically extends through the key body 8 at a central part thereof. A balance pin 11 extends upright from a balance rail 10 fixed to the top surface of a central part of the key bed 2. The key 3 is supported on the balance rail 10 such that it is turnable about the balance pin 11 fit into the balance pin hole 9 formed through the key body 8 thereof. Further, the key 3 is formed with a front pin hole 12 at a front end portion thereof, which opens downward or toward the key bed 2. A front pin 12' extending upright from a stopper 13 provided on the top surface of a front end portion of the key bed 2 is loosely fit in the pin hole 12, whereby the key 3 is vertically guided for prevention of sideways motions of the key 3. Further, when the key 3 is depressed, the lower limit position thereof is restricted by the stopper 13 on which abuts the bottom surface of the front end portion of the key 3**.

The action mechanism 4 is constituted by a grand piano action which is comprised of a jack 14, a repetition bar 15, a hammer 16 and a damper 17. The action mechanism 4 operates in a manner interlocked with the depression of the key 3 such that the hammer 16 thereof is thrust upward to strike the string 5 from below.

The keyboard apparatus 101 is provided with an L-shaped shank stopper 18 for changing over the operation mode of the grand piano between the acoustic performance mode and the muting performance mode. The shank stopper 18 is movably arranged such that it can be vertically shifted between an acoustic performance mode position (indicated by the solid lines in FIG. 1) at a higher level and a muting performance mode position (indicated by the broken lines in the same) at a lower level. The changeover of the mode position of the shank stopper 18 is carried out by operating a predetermined changeover switch, not shown. When the shank stopper 18 is in the acoustic performance mode position, the hammer 16 strikes the string 5, whereby the acoustic performance is allowed to be given, whereas when the shank stopper 18 is in the muting performance mode position, a hammer shank **16*a* of the hammer 16 abuts on the shank stopper 18 to cause the hammer 16 to stop before it reaches the string 5, thereby inhibiting the acoustic performance but permitting the muting performance based on key depression information generated by the key sensor switch device 6**.

The key sensor switch device 6 is removably mounted on the key bed 2 at a location on the front side of the balance rail 10. As shown in FIG. 1, the key sensor switch device 6 is an assembly of a base plate 19 extending crosswise to the longitudinal axis of the keyboard apparatus 101, a printed circuit board 20 fixed to the base plate 19, and a plurality of rubber switches 21 (only one of which is shown) arranged on the printed circuit board 20 in parallel with each other such that they are each opposed to the bottom surface of the associated key 3.

The base pate 19 is fit in an opening 22 formed through the key bed 2 such that a projection **19*a* on the front side of the base plate 19 is placed on a shoulder 22*a* formed on an inner front wall of the opening 22 to be hooked thereon, and fixed to the key bed 2 with screws 23. This construction of the key sensor switch device 6 and part associated therewith makes it possible to removably mount the key sensor switch device 6 in the key bed 2 by the base plate 9**.

The rubber switches 21 are of a type usually employed in electronic pianos, and each comprised of two rubber contact points, not shown, which are brought into contact with corresponding contact points, not shown, formed in the printed circuit board 20, according to respective different depression strokes of the key 3, to turn on the rubber switch 21 sequentially.

The control unit is formed by a microcomputer, and controls the operation of the tone generator according to ON signals delivered from the key sensor switch device 6. The tone generator, which is comprised of a tone generator LSI, generates electronic musical tones under the control of the control unit according to the key depression, and supplies the electronic musical tones to a player via a headphone.

Next, the operation of the above keyboard apparatus 101 will be described. When the acoustic performance is given, the screws 23 are first loosened to remove the key sensor switch device 6 from the key bed 2, and then the changeover switch is operated to move the shank stopper 18 to the acoustic performance mode position. In this state, when the key 3 is depressed, the action mechanism 4 operates in a manner interlocked with the key depression to thrust the hammer 16 upward to cause the same to strike the string 5. Thus, the acoustic performance can be given as usual.

When the muting performance is given, the key sensor switch device 6 is fit in the opening 22 of the key bed 2, and then the screws 23 are fastened to rigidly fix the key sensor switch device 6 to the key bed 2. Further, the changeover switch is operated to move the shank stopper 18 to the muting performance mode position. In this state, when the key 3 is depressed, the action mechanism 4 operates to thrust the hammer 16 upward but the shank stopper 18, on which the hammer shank 16*a* of the hammer 16 abuts, prevents the hammer 16 from striking the string 5. Therefore, no acoustic musical tones are generated.

On the other hand, according to the depression of the key 3, the key sensor switch device 6 operates to deliver ON signals to the control unit. The control unit determines the key number of the depressed key 3 from, the ON signals, and a key depression speed from a time interval between occurrences of the ON signals, and controls the operation of the tone generator based on the key number and the key depression speed. The tone generator generates electronic musical tones under the control of the control unit according to the key depression to supply the same to the player via the headphone. Therefore, the player can play the muting performance while listening to the electronic musical tones.

As described above, according to the keyboard apparatus 101, it is possible to selectively give the acoustic performance and the muting performance, as desired. When the acoustic performance is given, the key sensor switch device 6 is completely removed from the key bed 2, whereby the bottom surface of the key 3 is not brought into contact wish the key sensor switch device 6. Therefore, the key touch is not adversely affected by resilient reaction forces of the rubber switches of the key sensor switch device 6, but kept excellent.

Further, since the key sensor switch device 6 uses rubber switches, the material cost of the switches is much lower than that or conventional photoswitches. Further, the key sensor switch device 6 can be mounted on the key bed 2 with ease in a short time period after being assembled into one piece. Therefore it is possible to markedly reduce the cost of the key sensor switch device 6. Further, since a plurality of rubber switches 21 can be simultaneously mounted on the key bed 2 and be removed therefrom, by mounting the base plate 19 on the key bed 2 or removing the same therefrom, it is possible to mount the key sensor switch device 6 on the key bed 2 or remove the same therefrom more easily.

Figure 2:
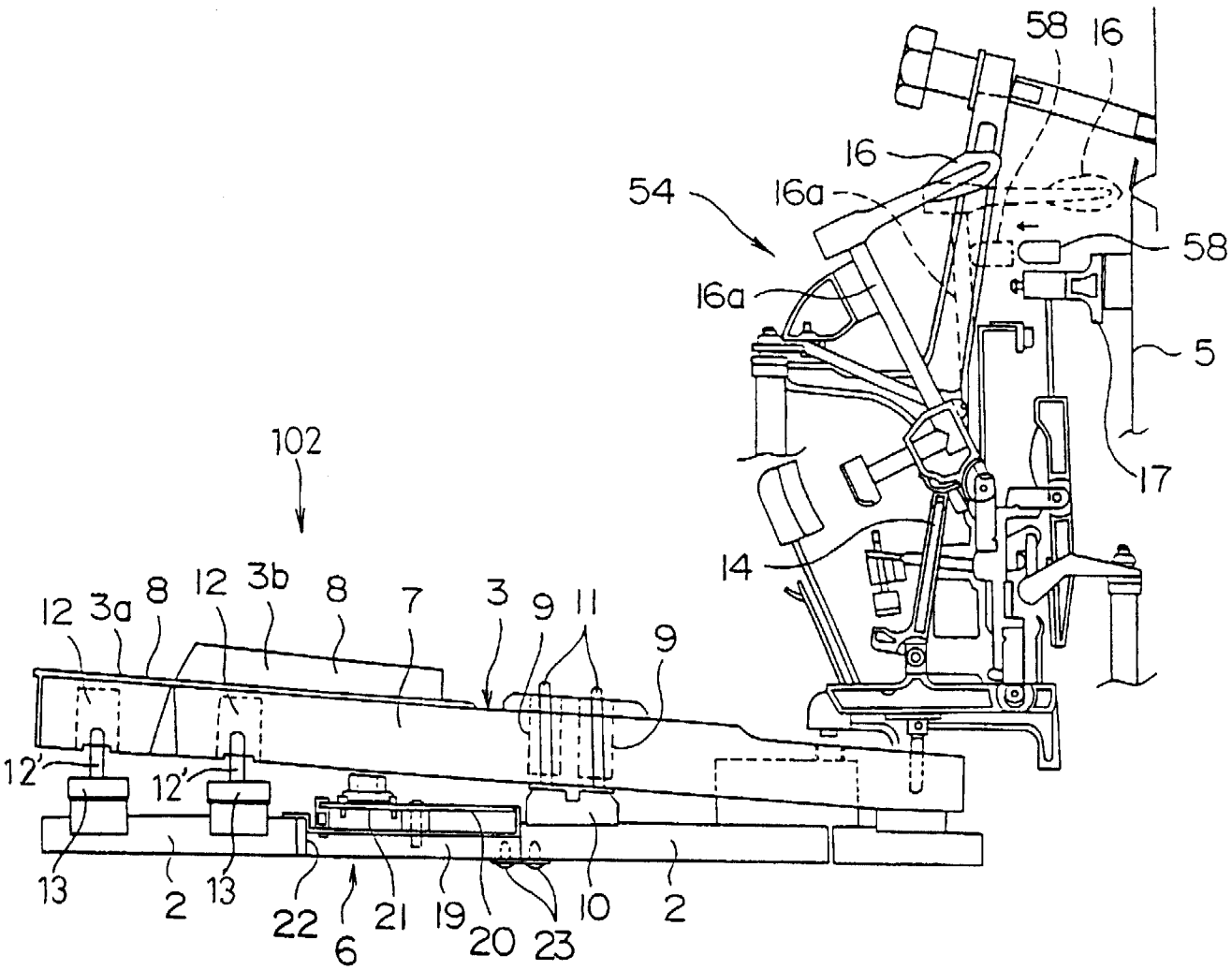
FIG. 2 is a side elevation showing a keyboard apparatus according to a second embodiment of the invention.

FIG. 2 shows a keyboard apparatus according to a second embodiment of the invention. In the figure, reference numeral 102 designates a keyboard apparatus in which the present invention is applied to an upright piano equipped with a muting function. Therefore, the keyboard apparatus 102 is distinguished from the keyboard apparatus 1 of the first embodiment only in that as the action mechanism an upright piano action 54 is used. Further, a shank stopper 58 for changing over the performance mode is arranged such that it can be moved in longitudinal directions between the acoustic performance mode position (indicated by the solid lines in FIG. 2) at a backward location and the muting performance mode position (indicated by the broken lines in FIG. 2) at a forward location. The remainder of the keyboard apparatus 102 is identical in construction to the keyboard apparatus 101 of the first embodiment. Therefore, it is possible to obtain quite the same effects from this embodiment as from the first embodiment.

Although the screws 23 are used in the above embodiments for removably fastening the key board switch device 6 to the key bed 2, this is not limitative, but various variations and modifications may be made thereto. FIGS. 3A and 3B, and 4A and 4B show such variations.

Figure 3A:
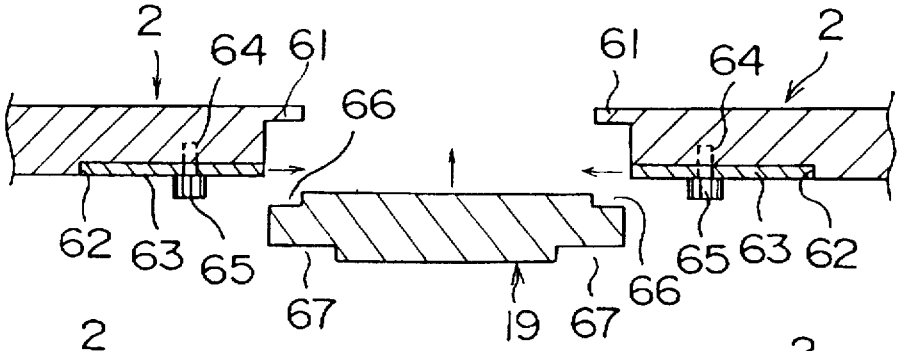
FIG. 3A is a cross-sectional view showing a variation of construction of a key sensor switch device for being removably mounted in a key bed of the keyboard apparatus according to the first or second embodiment, in a state of a base of the key sensor switch device removed from the key bed.
Figure 3B:
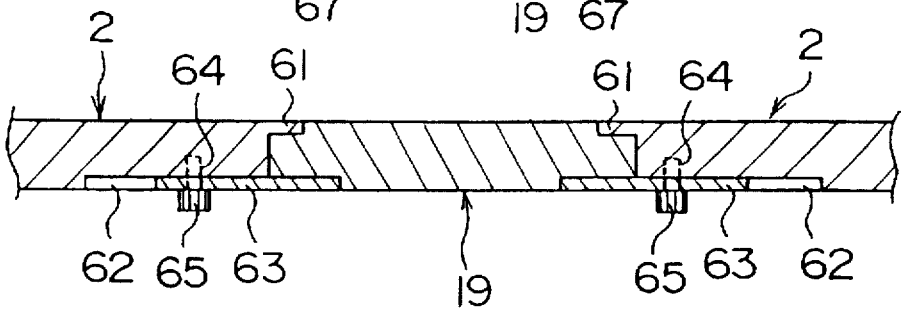
FIG. 3B is a cross-sectional view showing the FIG. 3A variation, in a state of the base of the key sensor switch device mounted on the key bed.

In the variation shown in FIGS. 3A and 3B, projections 61 are formed on top portions of opposed inner wall surfaces of an opening or gap formed through the key bed 2, and recesses 62, 62 are formed in bottom surfaces of portions of the key bed 2 adjacent to the opening. Slide plates 63, 63 are fit in the recesses 62, 62 respectively. Each slide plate 63 has a slot, not shown, which extends longitudinally. A screw 65 extends through the slot and has its tip screwed into a screw hole 64 formed in each of the portions of the key bed 2 adjacent to the opening. On the other hand, the base plate 19 of the key sensor switch device 6 has its top surface provided with cut-out portions 66, 66 and its bottom surface provided with cut-out portions 67, 67, such that they are associated with the projections 61, 61 of the key bed 2 and the slide plates 63, 63 respectively.

According to this arrangement, the base plate 19 is fit in the opening of the key bed 2 such that the cut-out portions 66, 66 of the base plate 19 are fit to the projections 61, 61 of the key bed 2, and then the screws 65, 65 are loosened to move the slide plates 63, 63 along the slots toward the center of the base plate 19 until the slide plates 63, 63 are fully engaged with the cut-out portions 67, 67 of the base plate 19. Finally, the screws 65, 65 are fastened, thereby firmly mounting the base plate 19, i.e. the key sensor switch device 6, to the key bed 2. When the key sensor switch device 6 is removed from the key bed 2, it is only required to reverse the above procedure. Unlike the above embodiments using the screws 23, this variation enables the base plate 19 to be mounted on the key bed 2 and removed therefrom with the screws 65 being attached to the key bed 2. Therefore, it is possible to carry out mounting and removing operations more easily.

Figure 4A:
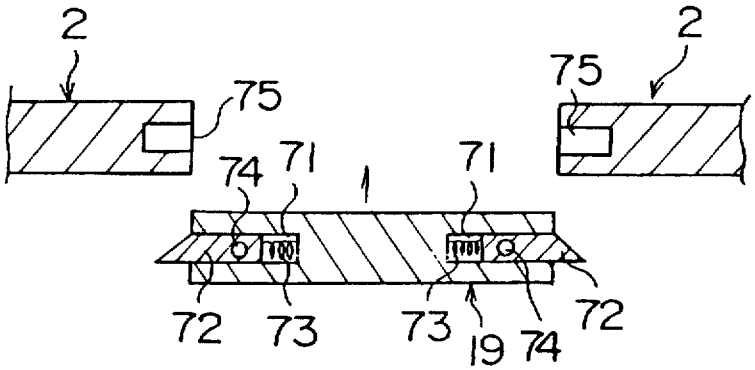
FIG. 4A is a cross-sectional view showing another variation similar to that shown in FIGS. 3A and 3B, in a state or a base thereof removed from the key bed.
Figure 4B:
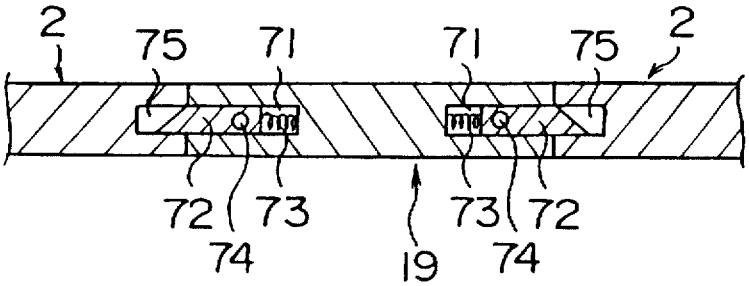
FIG. 4B is a cross-sectional view showing the FIG. 4A variation, in a state of the base mounted on the key bed.

In the variation shown in FIGS. 4A and 4B, grooves 71 are formed on opposite sides of the base plate 19, and locking pins 72, 72 are received in the grooves 71, 71, respectively. The locking pairs 72, 72 are biased by respective springs 73, 73 such that they are capable of projecting laterally out of the grooves and retracting therein. The locking pins 72, 72 each has a front open end formed with a tapered upper surface and a side formed with a knob 74. On the other hand, the key bed 2 has opposed inner wall surfaces formed with locking grooves 75, 75 which are to be associated with the locking pins 72, 72 respectively.

According to this arrangement, when the base plate 19 is forced into the gap in the key bed 2 in a direction designated by an arrow in FIG. 4A, the locking pins 72, 72 abut on the edges of the key bed 2 by the tapered upper surfaces thereof, and retract into the grooves 71, 71 by the reaction forces received from the edges. When the locking pins 72, 72 meet the locking grooves 75, 75 to be engaged therewith by the urging forces of the springs 73, 73, the former project into the latter. Thus, the base plate 19 is locked to the key bed 2 (see FIG. 4B). Further, to remove the key sensor switch device 6, the locking pins 72, 72 are pulled toward the center of the base plate 19 by the knobs 74 to cause the locking pins 72, 72 to be disengaged from the locking grooves 75, 75. According to this variation, the base plate 19 can be fit and locked to the key bed 2 and removed therefrom, in a snapping manner, which makes much easier the mounting and removing of the key sensor switch device 6.

In addition to the above variations, to removably mount the key sensor switch device 6 on the key bed 2, an inverted L-shaped groove which opens downward may be formed in side walls of the key bed 2, and a protection for engagement with the groove may be provided on the top surface of the base plate 19. The projection is fit into the groove from below, and then the base plate 19 is slid in a direction crosswise to the longitudinal axis of the keyboard apparatus.

Figure 5:
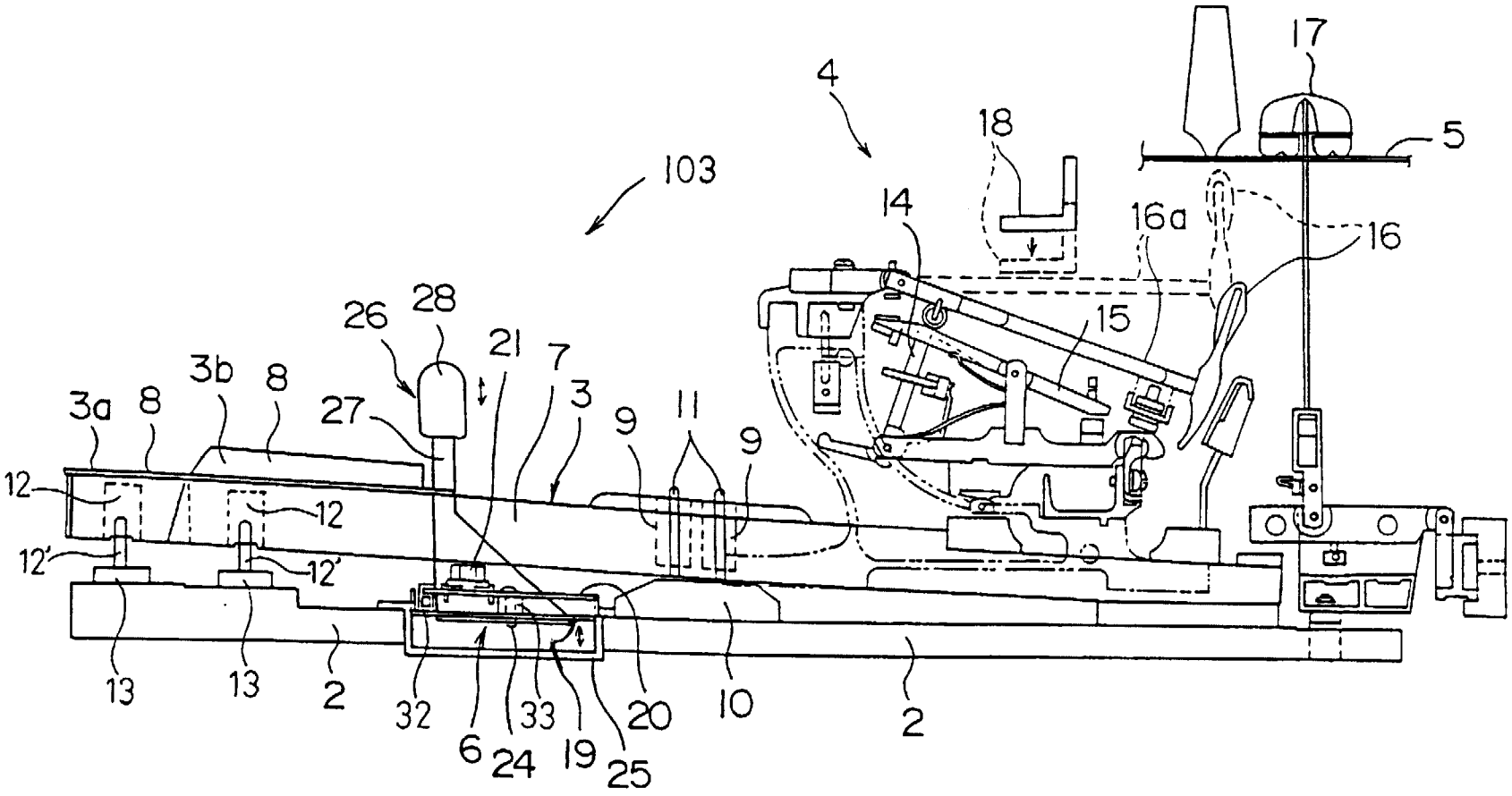
FIG. 5 is a side elevation showing a keyboard apparatus according to a third embodiment of the invention.

FIG. 5 shows a keyboard apparatus 103 for a grand piano equipped with the muting function, according to a third embodiment of the invention. This embodiment is distinguished from the first and second embodiments in that the key sensor switch device 6 is slidably mounted in the key bed 2.

More specifically, the key sensor switch device 6 is an assembly of the base plate 19 which has an U-shaped cross-section and extends crosswise to the longitudinal axis of the keyboard apparatus, the printed circuit board 20 fixed on the base plate 19, and the rubber switches (only one of which is shown) 21 arranged in number identical to the number of the keys on the printed circuit board 20 in parallel with each other such that they are opposed to respective bottom surfaces of the keys 3. The printed circuit board 20 has one end thereof sandwiched by a clamp 32 fixed to the base plate 19, and a central part thereof fixed to the base plate 19 by fastening the central part to the base plate 19 by means of screws 24 with a spacer 33 interposed in the printed circuit board 20.

The key sensor switch device 6 having the above construction is vertically slidably received in a casing 25 having a substantially U-shaped cross-section fixed to the front side of the balance rail 10. That is, the key sensor switch device 6 can be slid between a detecting position (as shown in FIG. 5) at a higher level and a non-detecting position at a lower level, with the outer surfaces of the side walls of the base plate 19 and the printed circuit board 20 being in sliding contact with the inner surfaces of the side walls of the casing 25. When the key sensor switch device 6 is in the detecting position, the rubber switches 21 are close to the keys 3, so that when any key 3 is depressed, the associated rubber switch 21 is depressed by the key 3, which makes it possible to generate key depression information. On the other hand, when the key sensor switch device 6 is in the non-detecting position, the rubber switches 21 are remote from the keys 3, so that even if any key 3 is depressed, the associated rubber switch 21 is not depressed by the key 3, which prevents the key sensor switch device 6 from generating key depression information.

In FIG. 5, reference numeral 26 designates an actuating lever for causing the key sensor switch device 6 to slide between the detecting position and the non-detecting position. The actuating lever 26 is provided in pair (only one of which is shown in the figure) for the key sensor switch device 6 on transversely opposite sides of a row of keys 3. Each actuating lever 26 is constituted by an actuating plate 27 and an operating knob 28. The actuating plate 27 has a bottom portion extending crosswise to the longitudinal axis of the keyboard apparatus, which is fastened to the bottom surface of the base plate 19 with the screws 24, and a vertical portion extending upward from the bottom portion to a level higher than the keys 3, with the operating knob 28 being arranged on the top of the vertical portion. In this connection, the actuating lever 26 is provided with a locking member, not shown, for holding the key sensor switch device 6 in the detecting position.

Next, the operation of the keyboard apparatus 103 of the present embodiment will be described. To give the acoustic performance, the actuating levers 26 are pressed down by the operating knobs 28 until the actuating plates 27 reach the upper surface of the bottom of the casing 25. Next, the changeover switch is operated to move the shank stopper 18 to the acoustic performance mode position. When any key 3 is depressed in this state, the action mechanism 4 operates in a manner interlocked with the key depression to thrust the hammer 16 upward to cause the same to strike the string 5. Thus, the acoustic performance is given as usual. In this case, the key sensor switch device 6 is in the non-detecting position which prevents the bottom surface of the key 3 from being brought into contact with the key sensor switch device 6. Therefore, the key touch is not adversely affected by resilient reaction forces of the rubber switches of the key sensor switch device 6, but kept as excellent as ever.

To give the muting performance, the operating knobs 28 of the actuator levers 26 are lifted to move the key sensor switch device 6 to the detecting position. Then, the changeover switch is operated to move the shank stopper 18 to the muting performance mode position. When any key 3 is depressed in this state, the action mechanism, 4 operates in a manner interlocked with the key depression to thrust the hammer 16 upward, but in this case, the hammer shank **16*a* of the hammer 16 abuts on the shank stopper 18, which prevents the hammer 16** from striking the, string, so that no string-stricken sounds are generated.

On the other hand, according to the depression of the key 3, the key sensor switch device 6, more particularly, the associated rubber switch 21, is operated by downward urging force of the bottom surface of the key 3 to generate ON signals which are delivered to the control unit. Therefore, similarly to the above embodiments, the player can give the muting performance while listening to electronic musical tones generated based on the ON signals.

As described above, according to the keyboard apparatus 103 of the present embodiment, it is possible to selectively give the acoustic performance and the muting performance as desired. To give the acoustic performance, the key sensor switch device 6 is slid to the non-detecting position, whereby the bottom surface of the key 3 is prevented from being brought into contact with the key sensor switch device 6. Therefore, the key touch is not adversely affected by resilient reaction forces of the rubber switches of the key sensor switch device 6, but kept as excellent as ever.

Further, in the present embodiment, all the rubber switches 21 can be simultaneously slid only by sliding the base plate 19 relative to the key bed 2. Therefore, it is possible to move the key sensor switch 6 between the detecting position and the non-detecting position more easily.

Figure 6:
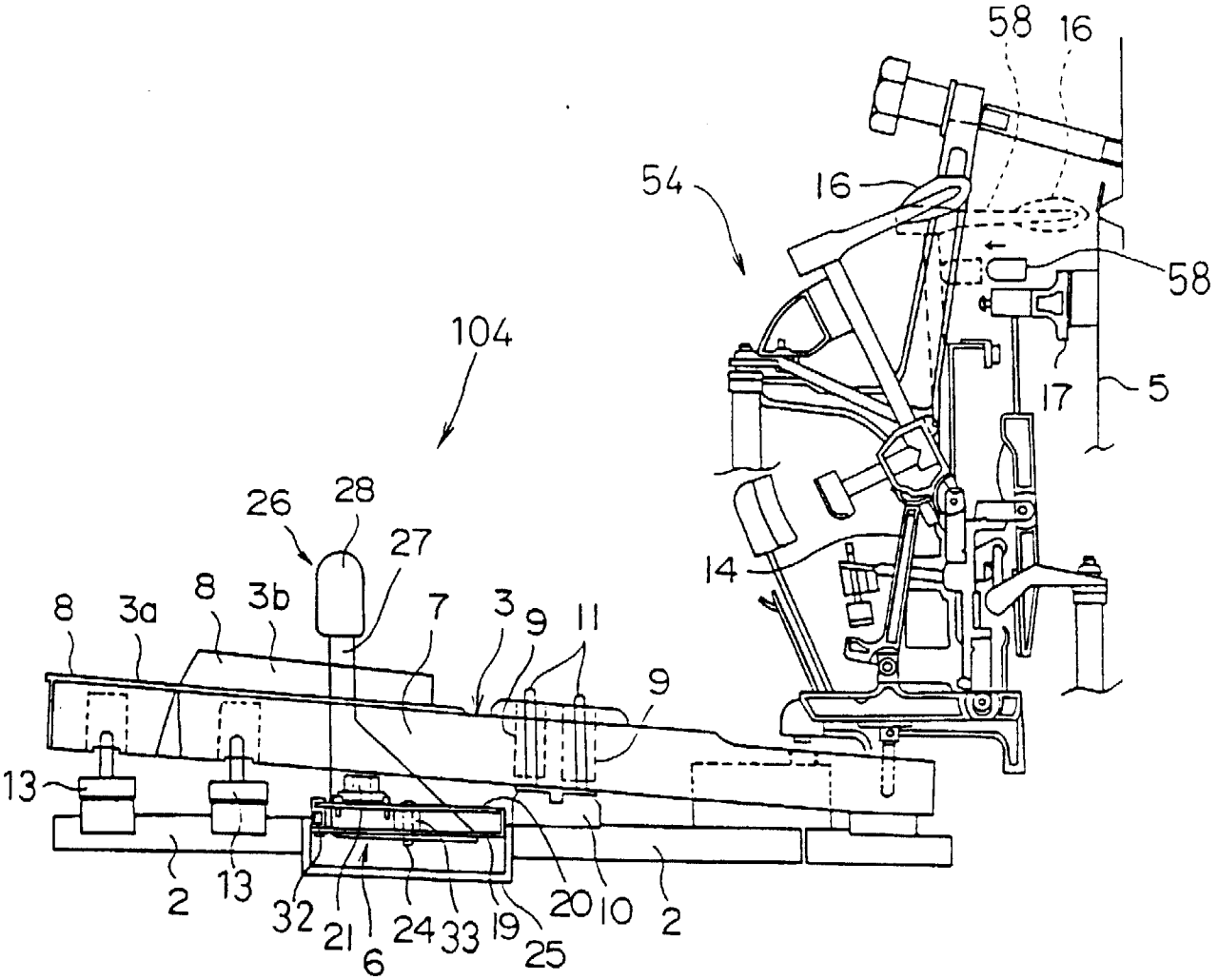
FIG. 6 is a side elevation showing a keyboard apparatus according to a fourth embodiment of the invention.

FIG. 6 shows a keyboard apparatus 104 for an upright piano, according to a fourth embodiment of the invention. The keyboard apparatus 104 is distinguished from the keyboard apparatus 103 of the third embodiment in that an upright piano action 54 is employed as the action mechanism. Therefore, the fourth embodiment can produce quite the same effects as produced by the third embodiment, just as the second embodiment can produce quite the same effects as produced by the first embodiment.

Figure 7A:
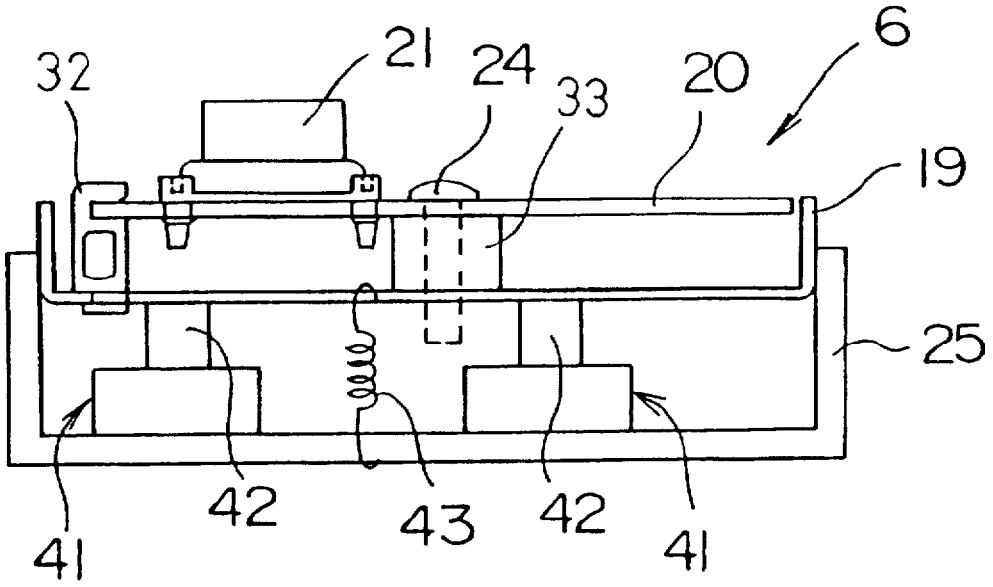
FIG. 7A is a cross-sectional view showing a variation of construction of a key sensor switch device slidably mounted on a key bed of the keyboard apparatus according to the third or fourth embodiment, in a state of the key sensor switch device being in a detecting position.
Figure 7B:
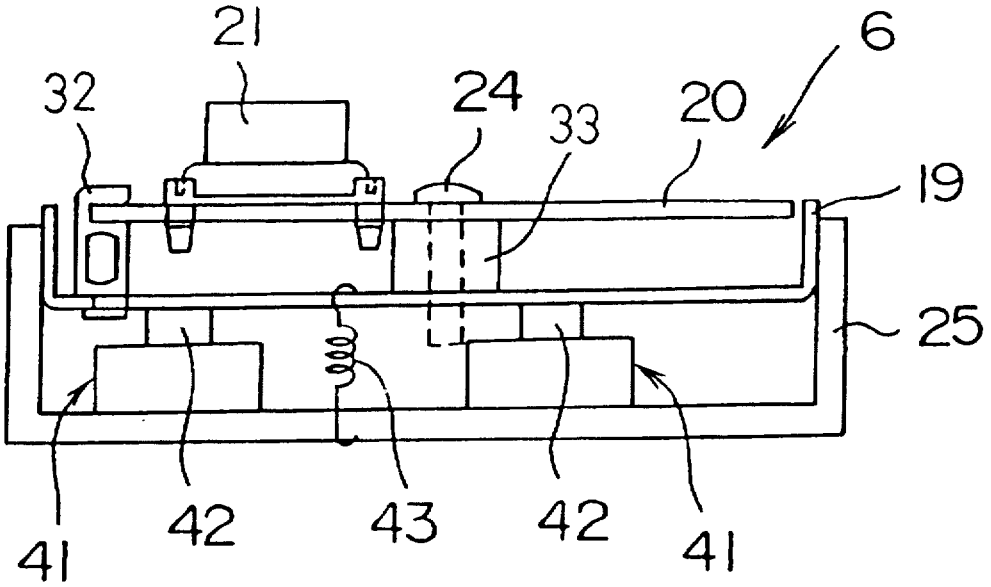
FIG. 7B is a cross-sectional view showing the FIG. 7A variation, in a state of the key sensor switch device being in a non-detecting position.

FIGS. 7A and 7B as well as 8A and 8B show variations of mechanisms for sliding the key sensor switch device 6.

In the variation shown in FIGS. 7A and 7B the actuating levers 26 of the third and fourth embodiments are replaced by a pair of solenoids 41, 41 for sliding the key sensor switch device 6. The solenoids 41, 41 are rigidly fixed to the upper surface of the bottom of the casing 25, and at the same time the base plate 19 is placed on plungers 42, 42 of the solenoids 41, 41. Further, the operation of the solenoids 41, 41 is directed by a switch, not shown, arranged on a operating panel, not shown, on which the keys 3 are arranged. A coiled spring 43 is stretched between the base plate 19 and the casing 25 for stabilizing the sliding operation of the key sensor switch device 6.

According to this construction, when the solenoids 41, 41 are not energized, the plungers 42, 42 retract to hold the key sensor switch device 6 placed thereon in the non-detection position at a lower level (see FIG. 7B). On the other hand, when the solenoids 41, 41 are energized, the plungers 42, 42 extend by a predetermined stroke to move the key sensor switch device 6 upward to the detecting position (see FIG. 7A). Therefore, in this variation, it is possible to automatically move the key sensor switch device 6 between the detecting position and the non-detection position by a single manipulation.

Figure 8A:
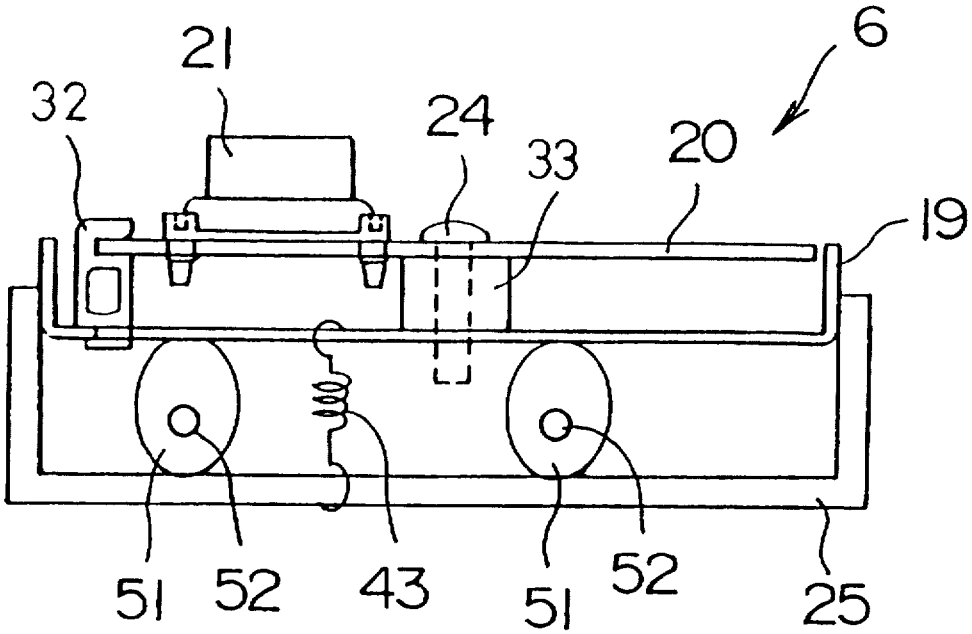
FIG. 8A is a cross-sectional view showing another variation similar to that shown in FIGS. 7A and 7B, in a state of the key sensor switch device being in the detecting position.
Figure 8B:
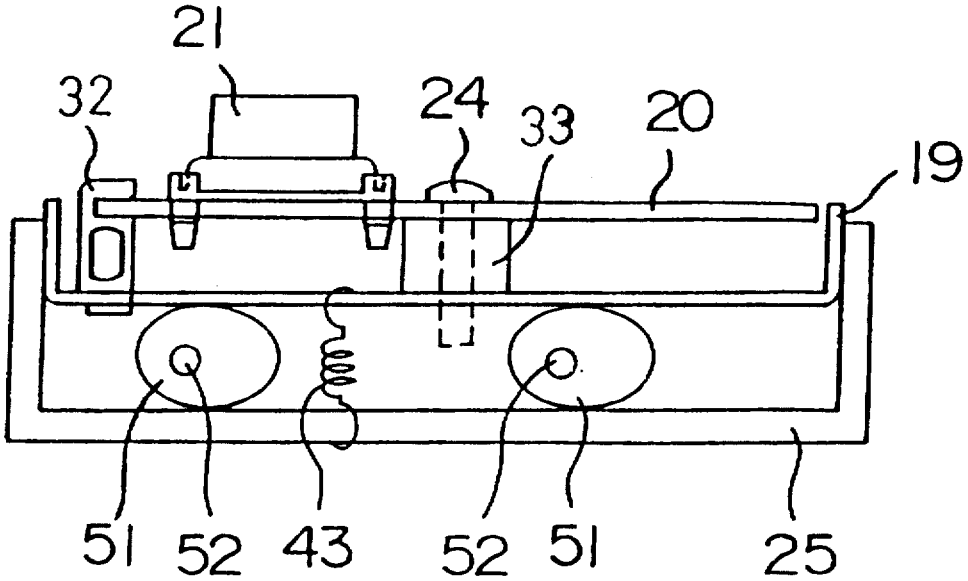
FIG. 8B is a cross-sectional view showing the FIG. 8A variation, in a state of the key sensor switch device being in the non-detecting position.

In the variation shown in FIGS. 8A and 8B, the key sensor switch device 6 is slid by a pair of eccentric cams 51, 51. The eccentric cams 51, 51 are arranged within the casing 25, and the base plate 19 is placed on them. Each eccentric cam 51 is rigidly fit on or integrally assembled with a drive shaft 52, and driven for rotation or angular movement by a drive mechanism, not shown, connected to the drive shaft 52, through direction by a switch, not shown, arranged on an operating panel, not shown.

According to this arrangement of the key sensor switch device 6 and parts associated therewith, when the switch on the operating panel is OFF, the cams 51 are each in a flat position (see FIG. 8B) in which the cars are longer in a side-to-side direction as viewed from the figure, whereby the key sensor switch device 6 is held in the non-detecting position at a lower level. On the other hand, when the switch is turned ON, the cams 51 are each brought into an upright position (see FIG. 8A) in which the calls are longer in a vertical direction, whereby the key sensor switch device 6 is moved upward to the detecting position at a higher level. Therefore, by this variation as well, the key sensor switch device 6 can be automatically shifted between the detecting position and the non-detecting position by a single manipulation of the switch.

Figure 9:
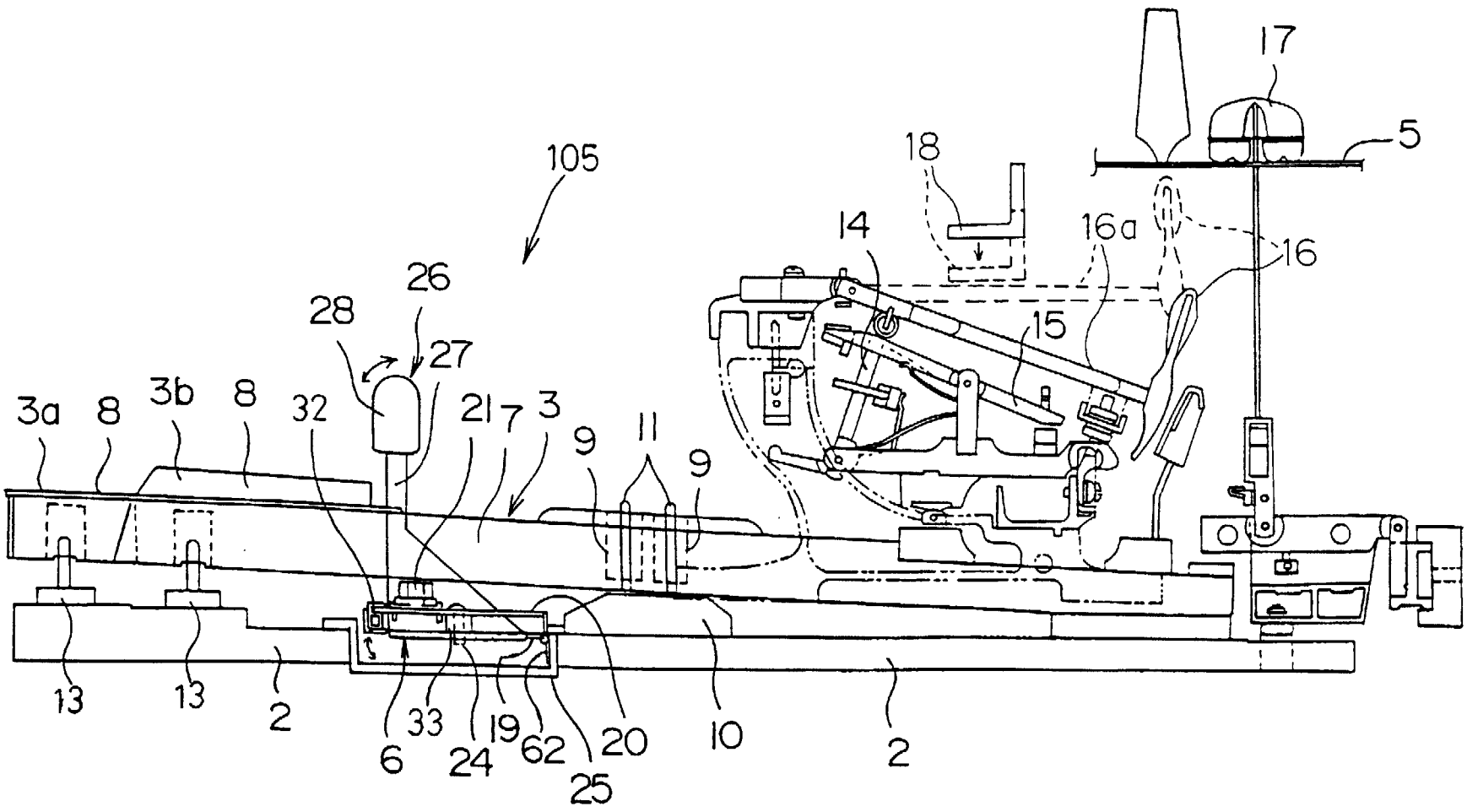
FIG. 9 is a side elevation showing a keyboard apparatus according to a fifth embodiment of the invention.

FIG. 9 shows a keyboard apparatus 105 according to a fifth embodiment. This embodiment is distinguished from the third embodiment in that the key sensor switch device 6 is mounted on the key bed 2 such that the key sensor switch device 6 can be pivotally moved, thereby permitting the key sensor switch device 6 to be shifted between the detecting position and the non-detecting position. More specifically, a hinge 62 is arranged to a top portion of an inner surface of a balance rail-side wall of the casing 25 having a U-shaped cross-section, and the base plate 19 is fixed to one leaf of the hinge 62. As a result, by operating the actuating lever 26 in directions designated by a double-headed arrow, the key sensor switch device 6 can be moved about the hinge 62 between the detecting position shown in FIG. 9 and the non-detecting position pivotally displaced to a lower level. As a result, it is possible to obtain the same effects as obtained in the third and fourth embodiments.

Figure 10:
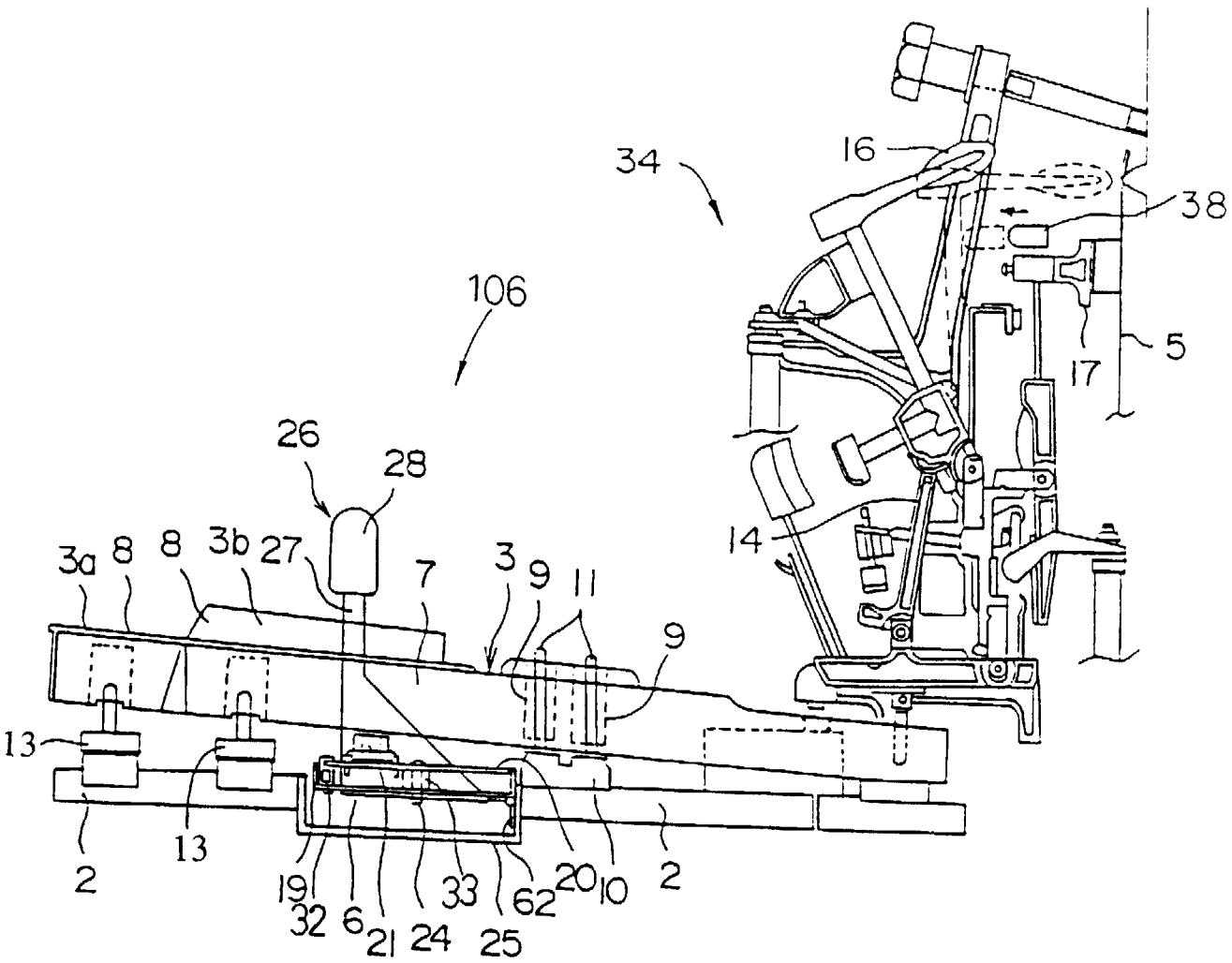
FIG. 10 is a side elevation showing a keyboard apparatus according to a sixth embodiment of the invention.

FIG. 10 shows a sixth embodiment. The keyboard apparatus 106 according to the sixth embodiment in which the key sensor switch device 6 is pivotally mounted on the key bed 2 similarly to FIG. 9 is an application of the invention to an upright piano, similarly to the fourth embodiment shown in FIG. 6. Therefore, detailed description thereof is omitted. The sixth embodiment can produce quite the same effects as the third to fifth embodiments.

Figure 11A:
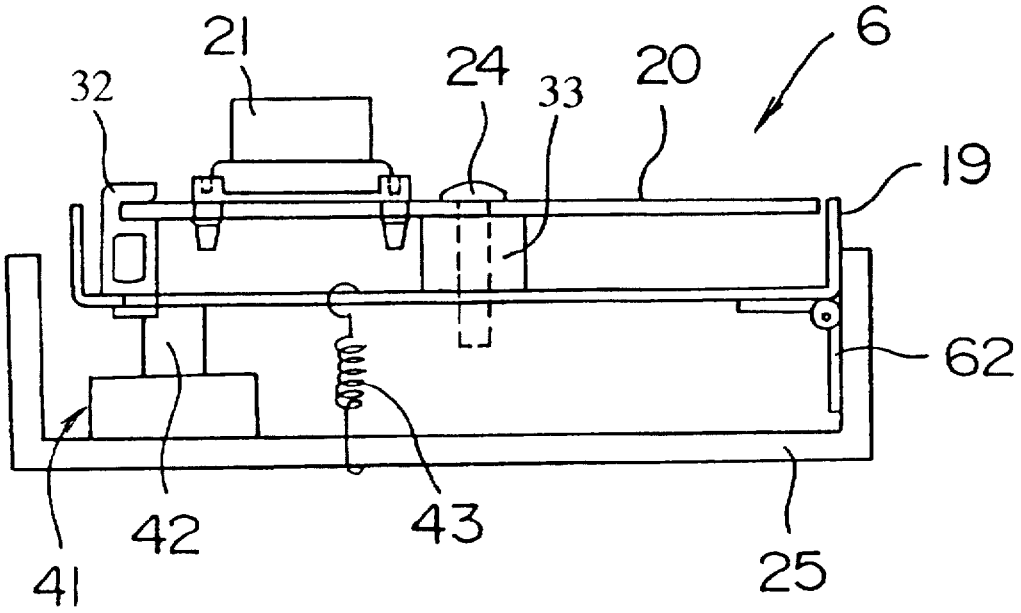
FIG. 11A is a cross-sectional view showing a variation of construction of a key sensor switch device pivotally mounted on a key bed of the keyboard apparatus according to the fifth or sixth embodiment, in a state of the key sensor switch device being in the detecting position.
Figure 11B:
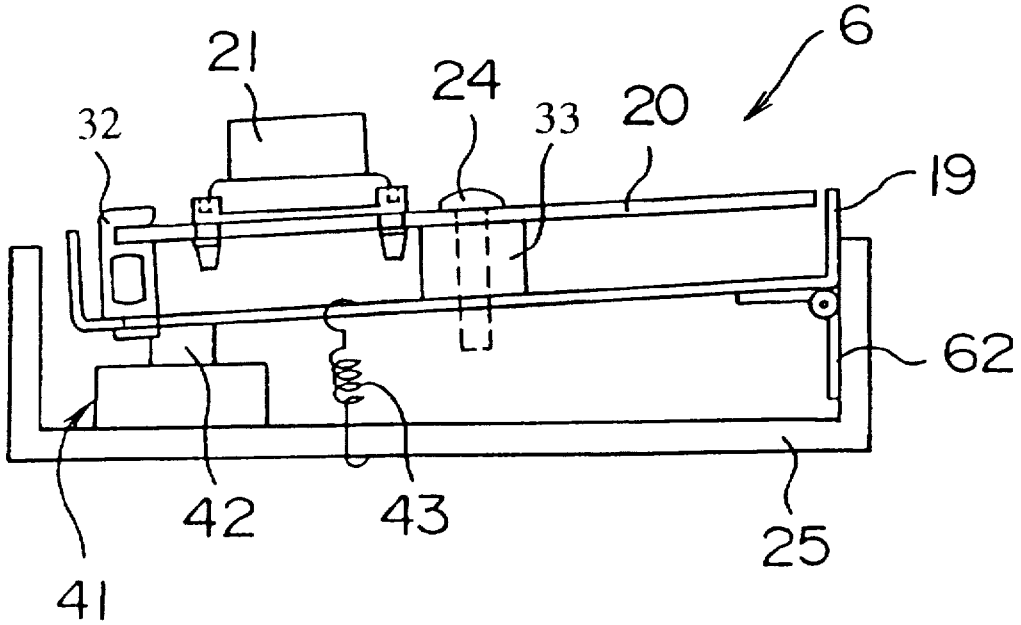
FIG. 11B is a cross-sectional view showing the FIG. 11A variation, in a state of the key sensor switch device being in the non-detecting position.

FIGS. 11A and 11B show a variation of the fifth and sixth embodiments, in which a single solenoid 41 constructed as described with reference to FIGS. 7A and 7B is provided in the casing 25 on a side opposite to the hinge 62 for pivotal arrangement of the key sensor switch device 6 in the key bed 2.

Figure 12A:
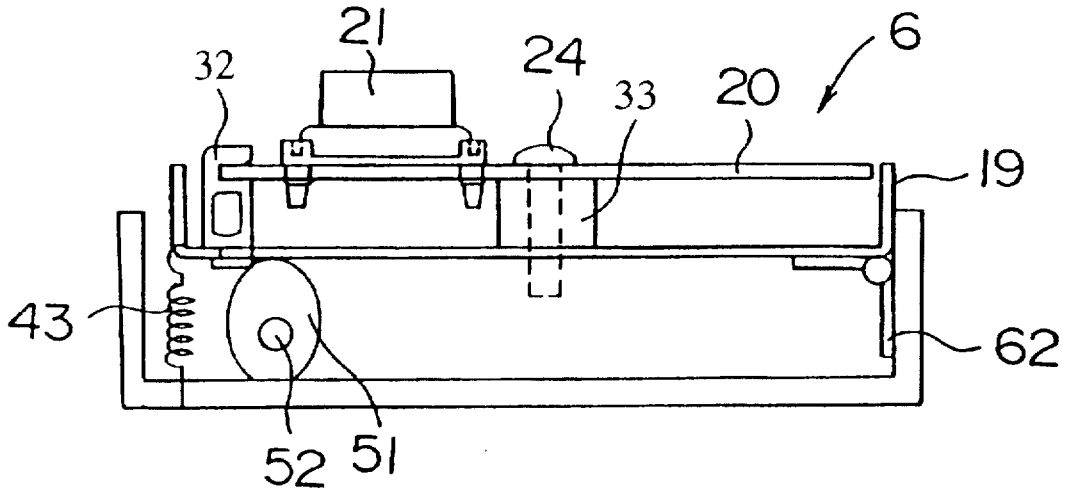
FIG. 12A is a cross-sectional view showing another variation similar to that shown in FIGS. 11A and 11B, in a state of the key sensor switch device being in the detecting position.
Figure 12B:
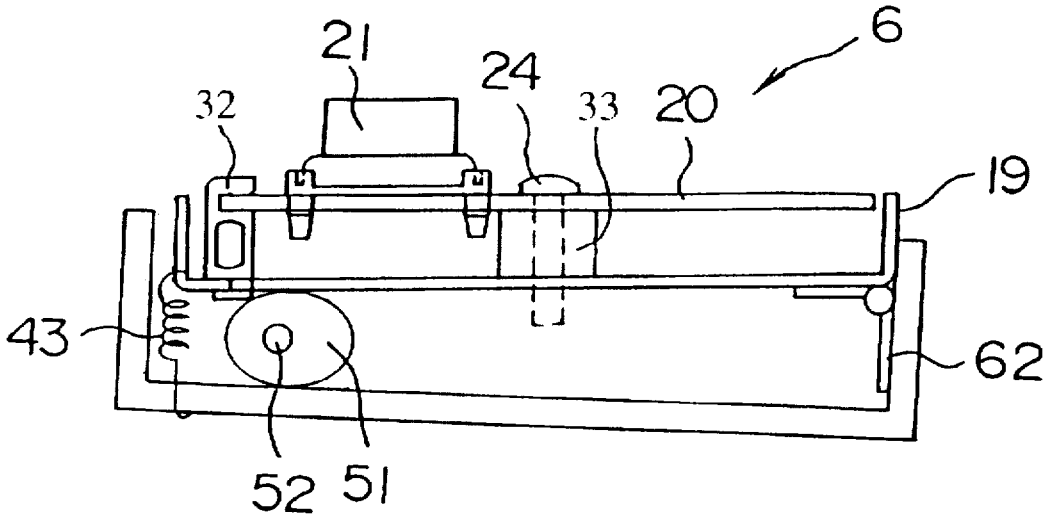
FIG. 12B is a cross-sectional view showing the FIG. 12A variation, in a state of the key sensor switch device being in the non-detecting position.

FIGS. 12A and 12B show a variation of the fifth and sixth embodiments, in which a single eccentric can 51 constructed as described with reference to FIGS. 8A and 8B is provided in the casing 25 on a side opposite to the hinge 62 for pivotal arrangement of the key sensor switch device 6 in the key bed 2.

These variations are also capable of producing quite the same effects as obtained by the fifth and sixth embodiments described above.

Further, although in the above embodiments, description has been made of the muting piano, this is not limitative, but it goes without saying that the invention can be applied to the autoplay piano, as well as to other acoustic pianos equipped with key sensor switches. For example, the invention can be applied to an acoustic piano adapted to generate key depression information by the key sensor switches and deliver MIDI signals indicative of the information to a remote or separate tone generator to cause the same to generate electronic musical tones.

Further, although in the above embodiments, all the rubber switches 21 are arranged on a single common base plate 19 in parallel with each other, this is not limitative, but the rubber switches 21 may be divided into several groups and each group of rubber switches 21 may be crosswise arranged on respective base plates 19 in a row, for removably or movably mounting the base plates 19 on the key bed 2.

The foregoing is considered as illustrative only of the principles of the present invention. Further, since numerous modification and changes will readily occur to those skilled in the art, it is not desired to limit the invention to the exact construction and applications shown and described, and accordingly, all suitable modifications and equivalents may be regarded as falling within the scope of the invention in the appended claims and their equivalents.

What is claimed is:

1. In a keyboard apparatus for an acoustic piano having strings, said keyboard apparatus being able to give muting and/or autoplay performances, including:

keys;

a key bed supporting said keys such that said keys are turnable thereon;

an action mechanism arranged at a rear end portion of each of said keys for striking an associated one of said strings to generate a musical tone in a manner interlocked with depression of said each of said keys; and a key sensor switch arranged on said key bed for generating key depression information for said each of said keys, the improvement wherein said key sensor switch is a rubber switch and is mounted on said key bed in a removable manner to avoid depression of said key sensor switch by said keys during an acoustic performance.

2. A keyboard apparatus according to claim 1, including a base having a plurality of key sensor switches mounted thereon in parallel with each other in a manner corresponding to respective ones of said keys, said base being removably mounted on said key bed.

3. A keyboard apparatus according to claim 2, wherein said key bed has an opening vertically extending therethrough, said base being removably arranged in said opening of said key bed.

4. A keyboard apparatus according to claim 3, wherein said base is fixed to said key bed with screws.

5. In a keyboard apparatus for an acoustic piano having strings, said keyboard apparatus being able to give muting and/or autoplay performances, including:

keys;

a key bed supporting said keys such that said keys are turnable thereon;

an action mechanism arranged at a rear end portion of each of said keys for striking an associated one of said strings to generate a musical tone in a manner interlocked with depression of said each of said keys; and a key sensor switch arranged on said key bed for generating key depression information for said each of said keys, wherein said key sensor switch is a rubber switch movably arranged in said key bed such that said key sensor switch is movable from a detecting position in which said key sensor switch is depressable by any of said keys, and a non-detecting position in which said key sensor switch cannot be depressed by any of said keys.

6. A keyboard apparatus according to claim 5, including a base having a plurality of key sensor switches mounted thereon in parallel with each other in a manner corresponding to respective ones of said keys, said base being movably mounted on said key bed.

7. A keyboard apparatus according to claim 5, wherein said key sensor switch is slidably arranged in said key bed such that said key sensor switch can be slid between said defecting position and said non-detecting position.

8. A keyboard apparatus according to claim 5, including a base having a plurality of key sensor switches mounted thereon in parallel with each other in a manner corresponding to respective ones of said keys, said base being slidably mounted on said key bed.

9. A keyboard apparatus according to claim 8, wherein said key bed has an opening vertically extending therethrough, and a casing fit in said opening, said base being slidably arranged in said casing.

10. A keyboard apparatus according to claim 9, including at least one solenoid interposed between said base and a bottom of said casing, wherein said at least one solenoid causes said base to slide such that said key sensor switches are moved between said detecting position and said non-detecting position.

11. A keyboard apparatus according to claim 9, including at least one eccentric cam interposed between said base and a bottom of said casing, wherein said at least one eccentric cam causes said base to slide such that said key sensor switches are moved between said detecting position and said non-detecting position.

12. In a keyboard apparatus for an acoustic piano having strings, including:

keys;

a key bed supporting said keys such that said keys are turnable thereon;

an action mechanism arranged at a rear end portion of each of said keys for striking an associated one of said strings to generate a musical tone in a manner interlocked with depression of said each of said keys; and a key sensor switch arranged on said key bed for generating key depression information for said each of said keys, wherein said key sensor switch is a rubber switch movably arranged in said key bed such that said key sensor switch is movable from a detecting position in which said key sensor switch is depressable by any of said keys, and a non-detecting position in which said key sensor switch cannot be depressed by any of said keys, wherein said key sensor switch is pivotally mounted on said key bed such that said key sensor switch can be pivotally moved between said detecting position and said non-detecting position.

13. In a keyboard apparatus for an acoustic piano having strings, including:

keys;

a key bed supporting said keys such that said keys are turnable thereon;

an action mechanism arranged at a rear end portion of each of said keys for striking an associated one of said strings to generate a musical tone in a manner interlocked with depression of said each of said keys; and a key sensor switch arranged on said key bed for generating key depression information for said each of said keys, wherein said key sensor switch is a rubber switch movably arranged in said key bed such that said key sensor switch is movable from a detecting position in which said key sensor switch is depressable by any of said keys, and a non-detecting position in which said key sensor switch cannot be depressed by any of said keys, including a base having a plurality of key sensor switches mounted thereon in parallel with each other in a manner corresponding to respective ones of said keys, said base being pivotally mounted on said key bed.

14. A keyboard apparatus according to claim 13, wherein said key bed has an opening vertically extending therethrough, and a casing fit in said opening, said base being pivotally arranged in said casing.

15. A keyboard apparatus according to claim 14, including at least one solenoid interposed between said base and a bottom of said casing, wherein said at least one solenoid causes said base to pivotally move such that said key sensor switches are moved between said detecting position and said non-detecting position.

16. A keyboard apparatus according to claim 14, including at least one eccentric cam interposed between said base and a bottom of said casing, wherein said at least one eccentric cam causes said base to pivotally move such that said key sensor switches are moved between said detecting position and said non-detecting position.

17. In a keyboard apparatus for an acoustic piano having strings, said keyboard apparatus being able to give muting and/or autoplay performances, including:

keys;

a key bed supporting said keys such that said keys are turnable thereon;

an action mechanism arranged at a rear end portion of each of said keys for striking an associated one of said strings to generate a musical tone in a manner interlocked with depression of said each of said keys; and a key sensor switch arranged on said key bed for generating key depression information for said each of said keys, wherein said key sensor switch is a rubber switch including means for movably arranging said key sensor switch in said key bed such that said key sensor switch is movable from a detecting position in which said key sensor switch is depressable by any of said keys, and a non-detecting position in which said key sensor switch cannot be depressed by any of said keys.

* * * * *